United States Patent [19]

Cooper et al.

[11] Patent Number: 4,570,061

[45] Date of Patent: Feb. 11, 1986

[54] FOLLOWER FINGER SHEET SEPARATING APPARATUS

[75] Inventors: Larry T. Cooper, Berthoud; Kenneth R. Primmer, Louisville, both of Colo.

[73] Assignee: International Business Machines Corporation, Armonk, N.Y.

[21] Appl. No.: 672,226

[22] Filed: Nov. 16, 1984

[51] Int. Cl.[4] ..... G01V 9/04; B65H 7/04

[52] U.S. Cl. ..... 250/222.1; 271/3.1; 271/4; 221/14; 414/125; 414/907

[58] Field of Search ..... 271/3.1, 4, 3, 5, 6, 271/7, 145, 147, 207; 221/14, 17, 18; 414/125, 907; 250/222.1

[56] References Cited

U.S. PATENT DOCUMENTS

| | | | |
|---|---|---|---|
| T103,301 | 8/1983 | Smith, Jr. | 271/3.1 |
| 3,556,513 | 12/1968 | Howard | 271/4 |
| 3,805,971 | 4/1974 | Behrens | 414/907 X |
| 3,895,790 | 7/1975 | Hoyer et al. | 271/10 |
| 4,076,408 | 2/1978 | Reid et al. | 355/14 |
| 4,078,787 | 3/1978 | Burlew et al. | 271/3.1 |
| 4,113,245 | 9/1978 | Colglazier et al. | 271/10 |
| 4,164,347 | 8/1979 | McGrain | 271/3.1 |
| 4,231,562 | 11/1980 | Hori | 271/3.1 |
| 4,293,214 | 10/1981 | George et al. | 355/14 R |
| 4,330,197 | 5/1982 | Smith et al. | 355/14 SH |
| 4,335,949 | 6/1982 | Kukucka et al. | 355/3 R |
| 4,338,023 | 7/1982 | McGibbon | 355/14 SH |

*Primary Examiner*—Bruce H. Stoner, Jr.
*Assistant Examiner*—Lawrence J. Goffney, Jr.
*Attorney, Agent, or Firm*—Francis A. Sirr

[57] ABSTRACT

A sheet stacking duplex tray includes a movable finger which separates a first group of sheets under the finger from a second group of sheets above the finger. Sheets which have been copied on only one side are fed to a copy station from the bottom of the tray for second-side copying, as other sheets which have been copied on only one side are fed to the tray, to reside on top of the finger. When all sheets of the first group have been fed, the finger gravity-falls through an opening in the tray. A detector senses this finger movement, and a solenoid then resets the finger to rest on the top sheet of the sheets then in the tray.

14 Claims, 9 Drawing Figures

FOLLOWER FINGER SHEET SEPARATING APPARATUS

DESCRIPTION

1. Field of the Invention

This invention relates to the field of sheet feeding or delivering, and to a follower finger which separates one group of sheets (i.e., a lower group) from an adjacent group of sheets (i.e., an upper group). The invention is of particular utility in the field of photocopying, for example the sequential copying of a stack of original documents to form a copy set(s) thereof; or the stacking of first-side copies prior to making second side copies, while in the process of making plural duplex copy sets.

2. Background of the Invention

The use of a gravity-responsive, pivoted finger member, to sense the removal of a sheet-like object upon which the member rests, is old in the art. Such prior art members appear to have been used primarily in the art of recirculating automatic document feeders (RADF) of the type used in high performance photocopying apparatus, or copiers.

Defensive publication T103,301 discloses a copier's RADF wherein a separator finger (312), and its shaft (319), carry a cam (316). When the bottom document of a stack has been fed, the finger falls below the document tray (203), and the cam rotates to close a switch. As a result, a motor (320) is energized. This motor drives a roller (324) which in turn drives the finger's shaft, causing the finger to rotate approximately 360°, resetting the finger to the top of the stack of documents. Just prior to this resetting, the cam causes the switch to open, and the motor is deenergized.

U.S. Pat. No. 4,164,347 also discloses a RADF having a generally similar separator finger (30). In this case, the motor (36) which is energized when the finger falls below the document stack, operates to rotate a gear (38) having three pawls (48) equally spaced about the gear's periphery. These pawls cooperate with a pin (62) which is carried by the finger. The motor, its gear, and the pawls, reset the finger onto the top of the document stack. The motor is then deenergized.

U.S. Pat. Nos, 3,895,790; 4,076,408; 4,078,787; 4,231,562; 4,293,214; 4,330,197; 4,335,949; and 4,338,023 also show RADF's with a separator finger, or a bail bar, which is reset by motors, clutches, etc.

The present invention provides a similar function with a simple, low cost apparatus having high reliability.

The above-mentioned patents are incorporated herein by reference for the purpose of indicating the background of the invention and as illustrative of the state of the art.

SUMMARY OF THE INVENTION

The present invention will be described as it is useful in the art of duplex copying, i.e., the copying of document images on both sides of a sheet of transfer material, usually plain bond paper. However, utility of the present invention is not limited thereto. Another apparent utility is in document feeders of the type above described.

The particular duplex tray to be described is a first-in/first-out (FIFO) tray, wherein the tray comprises a generally horizontal, planar platform upon which sheets having an image on only one side reside, awaiting feeding for copying on the other side of the sheet. The follower finger of the present invention extends above, and rests upon, a group of underlying similar sheets. The finger thus separates these sheets from dissimilar sheets which may reside in the tray at a location above the finger. As sheets are fed from below the finger, the finger follows the boundary between the group of sheets under the finger, and the group of sheets above the finger. Thus, the term follower finger is used to describe this member.

This invention is characterized by its simplicity, which in turn contributes to low manufacturing and service cost, as well as to functional reliability.

The invention comprises, in its more detailed form, a generally flat, elongated, toggle-like link which freely slides and pivots relative a stationary shaft. A solenoid is momentarily energized, to elevate or lift the link, as the link slides on the shaft. As the link is elevated, its upper surface engages a stationary, inclined cam surface, and the link is tipped from its vertical attitude. When the link's center of gravity moves out of the vertical plane occupied by the shaft, the link falls over, as it pivots about the shaft. The link then comes to rest on sheets within the duplex tray. When the sheets under the link have been removed, the link continues falling. This additional fall movement is sensed, by a light/-photocell couple for example.

The link has now rotated 180° and its aforesaid upper surface is now its lower surface. The link is now ready to be reset by operation of the solenoid.

The foregoing and other features and advantages of the invention will be apparent from the following more particular description of preferred embodiments of the invention, as illustrated in the accompanying drawing.

THE INVENTION

Figure 1:
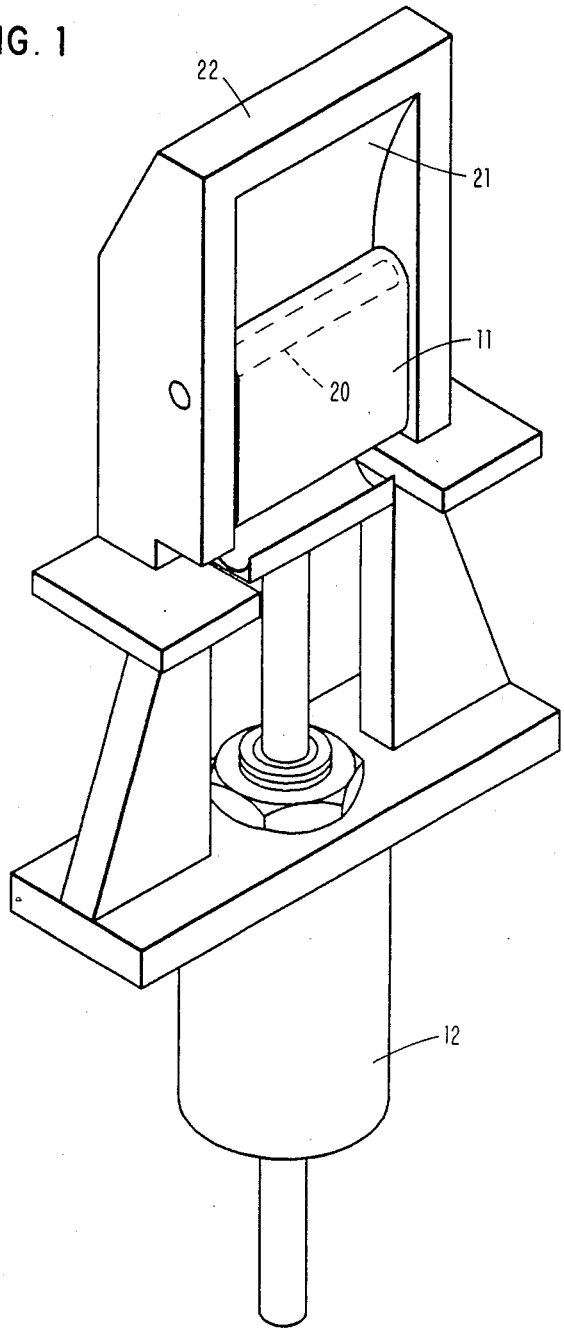
FIG. 1 is a front perspective view of one embodiment of the present invention, showing the solenoid pusher means in its deenergized and lowered position.
Figure 2:
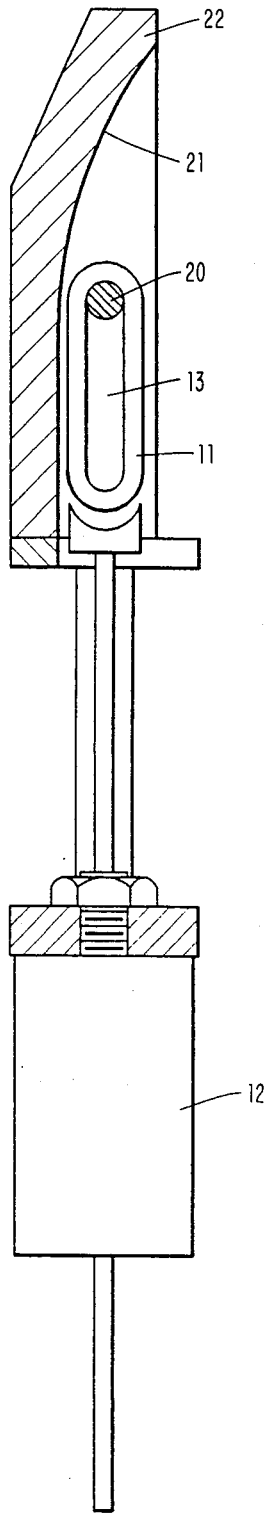
FIG. 2 is a side view of the apparatus of FIG. 1.

The present invention finds particular utility when used with a FIFO duplex tray. The art of duplex copying is well known and will not be described herein; other than to relate operation of the aforedescribed follower finger structure to such a duplex tray.

For simplicity of explanation, it will be assumed that a four-sheet original document having image pages 1-on one side of each sheet (i.e., a four-sheet simplex original set) is in a recirculating document feeder (RADF) which operates to present the sheets to a copy station in reoccurring 1-2-3-4 page sequence—as many times as is necessary to satisfy the copy request for two-sheet duplex copy sets. Such a copier or reproduction device is well known, and will not be described herein.

Assume that the operator requests three duplex copy sets of this original simplex set. Each duplex copy set will comprise two copy sheets, one copy sheet having original image page 1 and page 2 on opposite sides thereof, and the other copy sheet having original image page 3 and page 4 on opposite sides thereof.

With the use of this invention, one more circulation of the original document through the copy station will occur than the operator's set request, i.e., four circulations in this assumed case.

During the first circulation, page 1 is copied and the copy sheet is placed in the duplex tray 10—page 2 is skipped, i.e., it passes through the copy station without being copied—page 3 is copied and the copy sheet is placed in the duplex tray on top of the page 1 copy—and page 4 is skipped. The follower finger 111 (or 11 for the invention's first embodiment) is now placed on top of the page 3 copy—see FIG. 4. The original document is now once again in its original page sequence in the RADF.

Note that no copy sheets exit the copier during this first circulation of the original document.

During the second and all subsequent circulations of the original document, all sheets are copied, i.e., none are skipped, and one copy set exits the copier for each circulation of the original through the copy station.

More specifically, during the second circulation, page 1 is copied on a blank sheet of paper, and the copy sheet is placed in the duplex tray, on top of the finger (FIG. 5)—page 2 is copied on the blank side of the bottom sheet taken from the FIFO duplex tray, and a sheet exits the copier having image page 1 on one side and image page 2 on the opposite side—page 3 is copied on a blank sheet of paper, and the copy sheet is placed on top of the page 1 copy (FIG. 5)—page 4 is copied on the blank side of the bottom sheet taken from the duplex tray, and a sheet exits the copier having page 3 on one side and page 4 on the other side.

Figure 6:
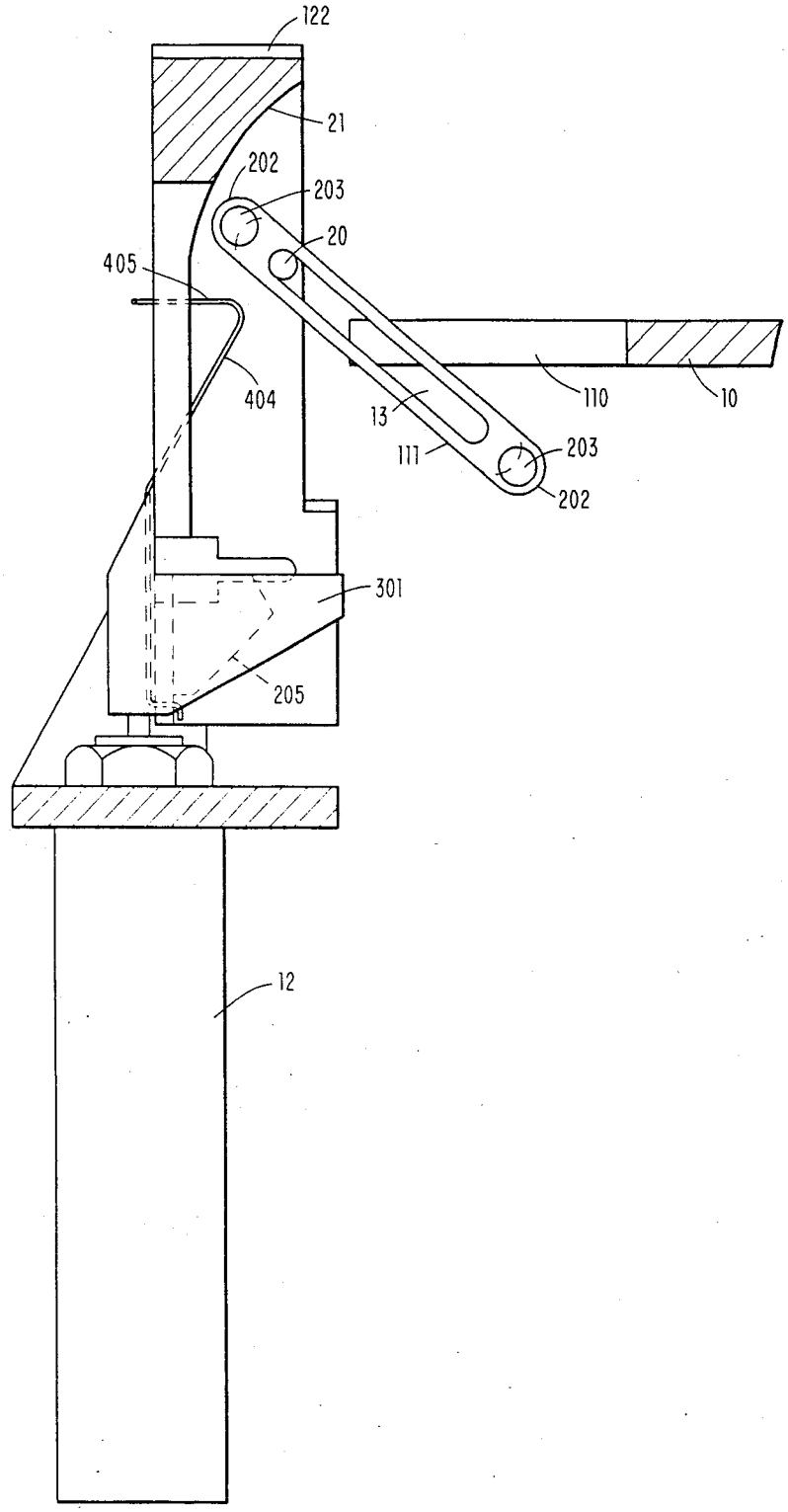
FIG. 6 shows the finger as it falls CW when the last sheet of the underlying stack is removed.

The first requested set has now been made. In addition, the follower finger has been released (FIG. 6). Falling of the follower finger is sensed to (1) count one duplex set as being produced, and (2) to reset the follower finger. Solenoid 12 is now energized, causing the finger to again assume its FIG. 4 reset position. The finger has now traveled 360°, to come to rest on top of the two sheets now in the duplex tray. A counter has been incremented to count that one set has been made.

Follower finger 11 (for the first embodiment, or 111 for the second embodiment) is a rigid member, for example metal or plastic, which is shaped or made in the form of a flat, elongated, hollow belt. That is, its center 13 is in the form of an elongated slot. This slot receives stationary pin or shaft 20 upon which the follower finger is movably mounted. The FIGS. 1 and 3 positions of the finger show one end of the slot resting upon pin 20.

Figure 4:
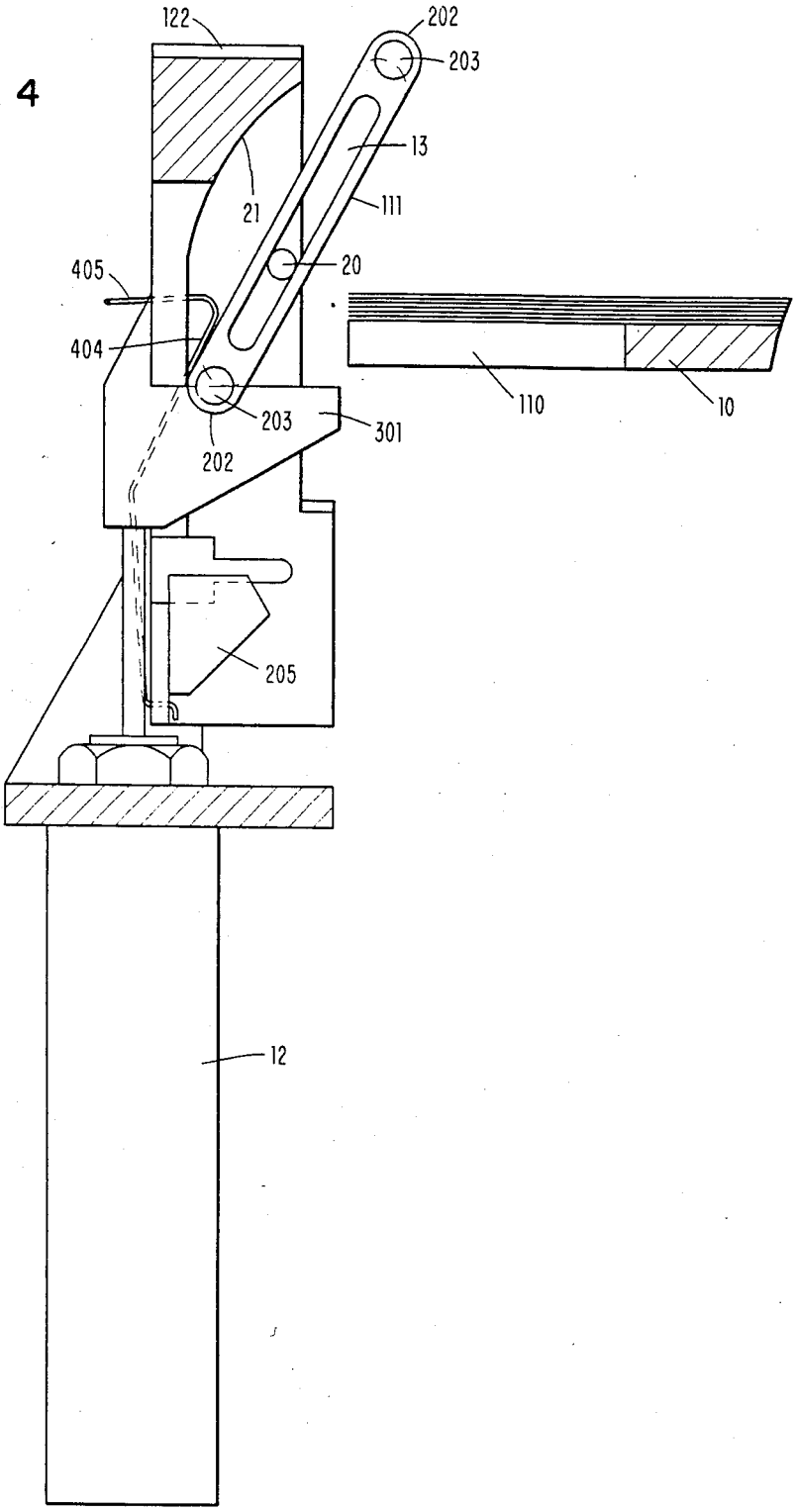
FIG. 4 shows the FIG. 3 device with the solenoid plunger partially elevated, such that the follower finger's top surface has engaged and then disengaged the cam surface, causing the finger to tip and start its gravity fall, and causing the finger to rotate clockwise (CW)

In FIG. 4, energization of solenoid 12 has raised the finger such that the finger moves upward. During this upward movement, the finger is guided by pin 20, and finally by a cam surface 21 which is formed in housing 22 for the first embodiment, and housing 122 of the second embodiment.

Figure 5:
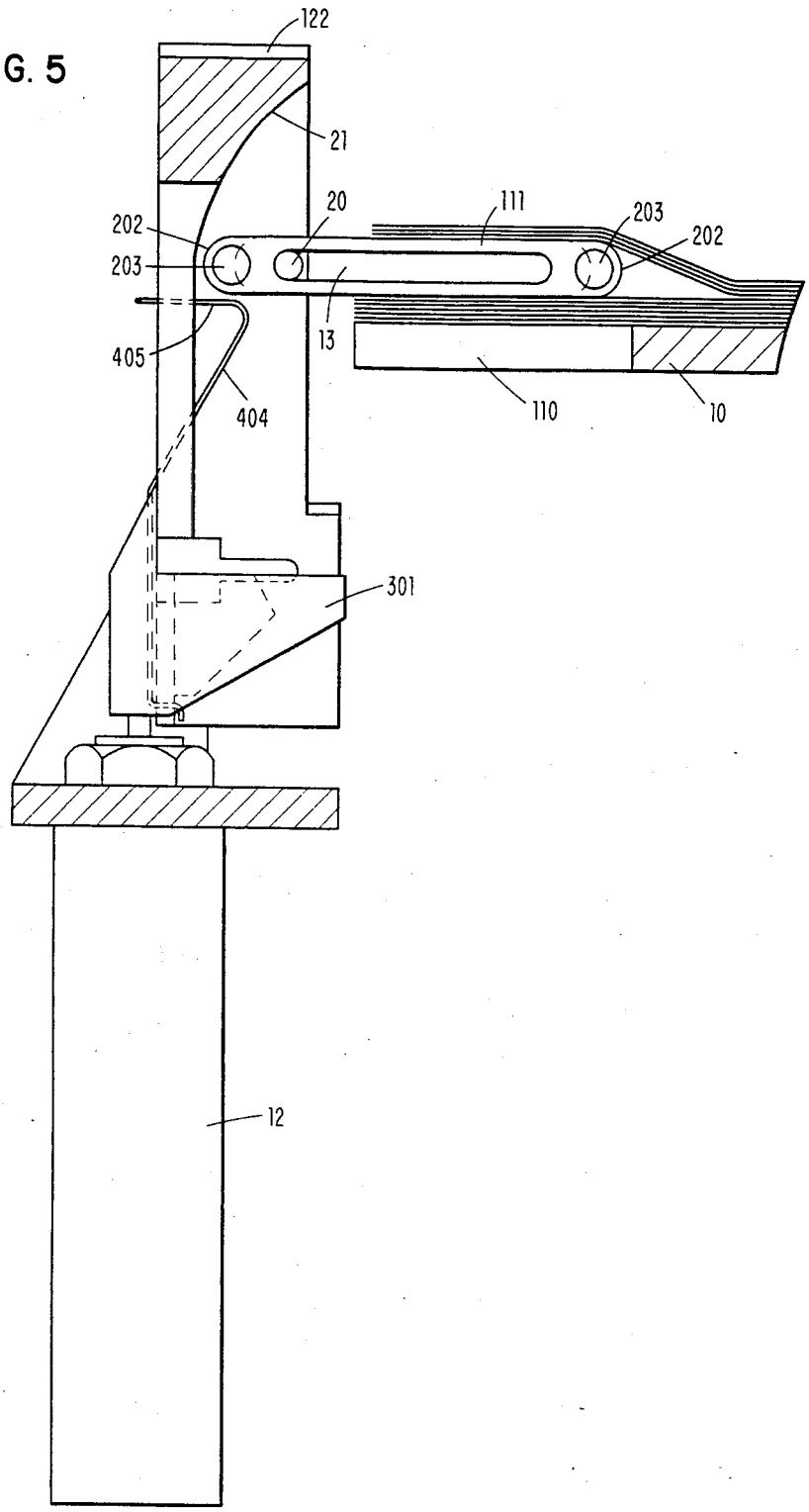
FIG. 5 shows the finger, as it separates the lower sheets of the stack from sheets which have been subsequently fed to the duplex tray.

As the finger continues to move upward, the shape of cam surface 21 causes the finger to pivot out of a vertical plane which contains pin 20. Near the top of the solenoid's vertical stroke, the finger moves to a position where its center of gravity no longer resides within the vertical plane of pin 20. When this occurs, the finger gravity-falls onto the sheets within FIFO tray 10 (FIG. 4). Dissimilar sheets can now be fed onto the top of the finger, as other sheets are fed out of the tray, from the bottom of the group of sheets residing under the finger (FIG. 5).

When the last sheet of the group of sheets under the finger has been fed, the finger continues its gravity fall (FIG. 6). The finger now comes to rest at the FIG. 1, 2, 3, 8 position, but with the other end of its internal slot 13 resting on pin 20. A sensor is provided to sense the FIG. 5-to-FIG. 3 movement of the finger. This sensor generates a signal which indicates to the reproduction device's (copier) logic that the group of sheets under the finger (FIG. 5) have all been fed.

This process now repeats for two more circulations of the original document, in order to make the requested three sets. During the second of these two circulators, only the even numbered pages are copied.

Another utility of this invention is when the reproduction device is first turned on, such as at the beginning of a work day. In this case, solenoid 12 is automatically energized, as part of a start-up procedure, to insure that the paper tray with which the invention is associated does not have paper therein, as for example paper which was improperly left over from a prior use of the reproduction device. If the tray is empty, as it should be, the finger immediately cycles from its FIG. 3 position, through its FIG. 4, 5 and 6 positions, and back to its FIG. 3 position. This special case of operation is sensed by the sensor, and a signal is passed to the start-up logic that the tray is empty, as it should be during start-up.

Figure 7:
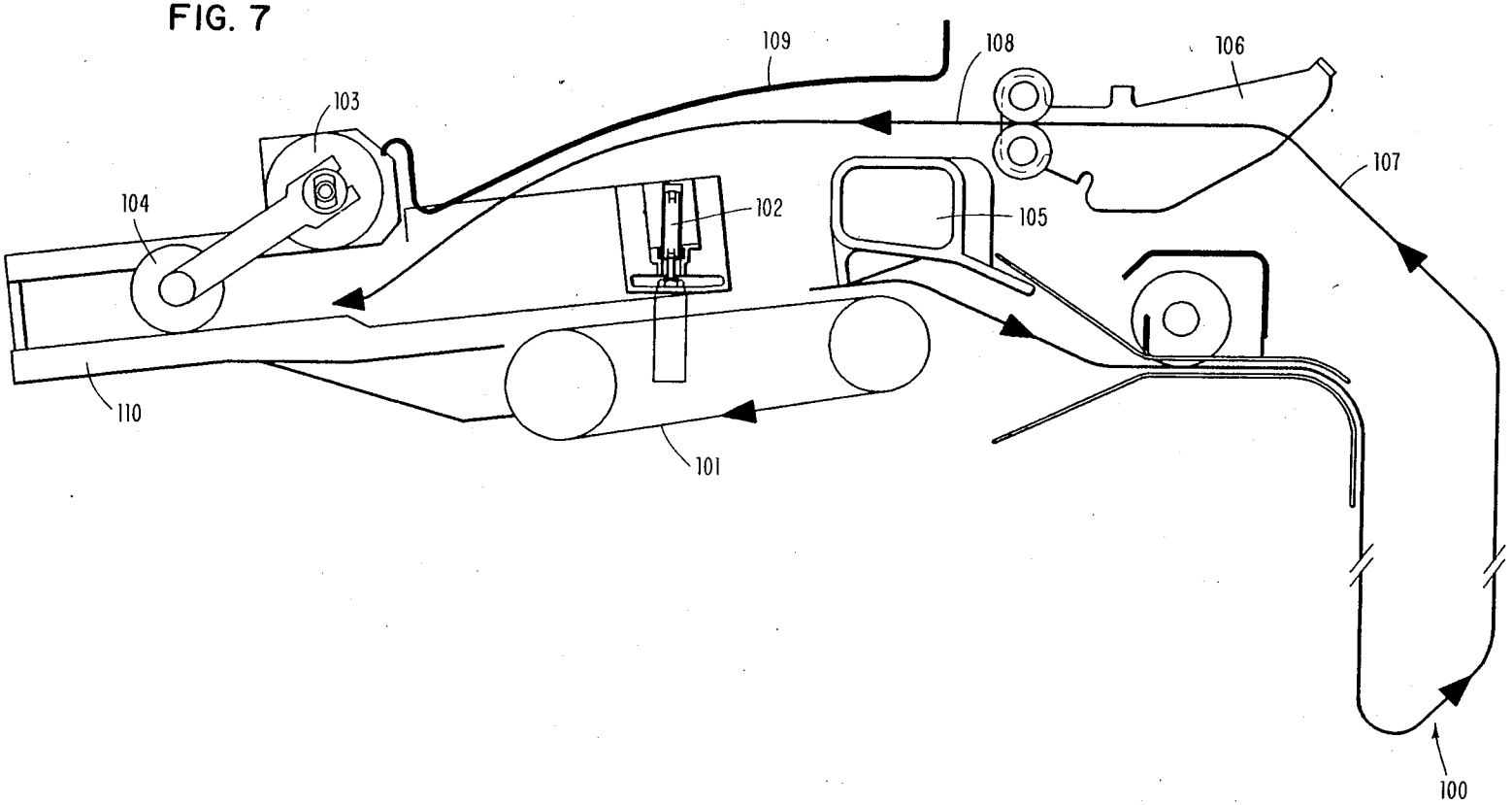
FIG. 7 is a schematic side view of a FIFO duplex tray in which the present invention is used.
Figure 8:
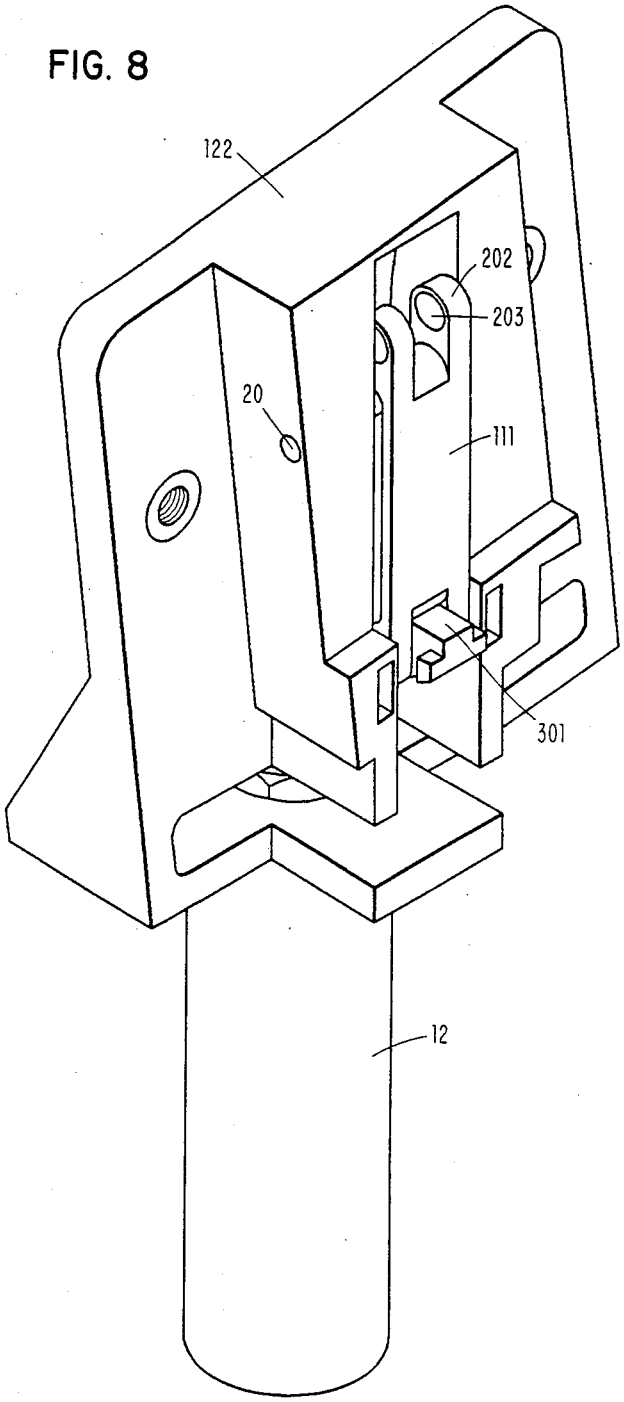
FIGS. 8 and 9 are other views of the second embodiment of the present invention.

FIG. 7 shows a FIFO duplex tray incorporating the present invention. The use of the FIG. 7 tray in a reproduction device is exemplified by reference to U.S. Pat. No. 4,113,245, incorporated herein by reference. It is suggested that duplex tray 36 of that patent be replaced by the duplex tray of FIG. 7.

The tray of FIG. 7 includes a generally horizontal table 10 on which the side-one copies are stacked, as they await return to copy process station 100 for side-two copying. Tray 10 includes a cutout (see 110 of FIG. 3) which allows the follower finger to drop through the tray when the last sheet under the finger has been fed away (FIG. 6). A vacuum transport belt 101 operates to remove the tray's bottom sheets, one at a time, under the control of the reproduction device's control logic.

Reference number 102 designates generally the location of the follower finger of the present invention. This finger operates to separate copy sheet groups of dissimilar images, as above described.

Sheets are stacked on table 10 by operation of stacking motor 103 and friction wheel 104 which is driven by the motor. An air knife chamber 105 extends across the front of the FIFO tray and operates to separate the right-hand portions of the sheets within the tray, thus aiding in the reliable feeding of only one sheet at a time by belt 101.

The reproduction device includes a movable sheet guide member 106 which is shown in a position to cause sheets traversing copy path 107 to pass to path 108, whereat the sheet's leading edge is caused to engage stationary deflector surface 109. This deflector guides the sheet under wheel 104, and the sheet is stacked in the FIFO tray, on top of the sheets already in the tray, and on top of the follower finger, in the manner shown in FIG. 5. In the alternate position of sheet guide member 106, the member is pivoted clockwise, such that finished duplex copies (i.e., sheets having images on both sides of the sheet) are routed to an exit tray, not shown, which exit tray is positioned above table 10.

The exact construction of the FIG. 7 FIFO tray, which provides exemplary utility for the present invention, is of no importance to an understanding of the present invention, and other constructions of duplex trays, and document feeders, with which this invention can be used will be apparent to those of skill in the art.

In the second embodiment of the present invention, follower finger 111 is of the same general shape, and pivots about pin or shaft 20 just as the finger of the first embodiment pivots about pin 20. In the case of the second embodiment, the finger is made of a nonmagnetic plastic, and the two end extremities of the finger each contain a U-shaped recess 201, thus forming two spaced, extending tabs 202 on each end of the finger. Each of these tabs mounts a weight in the form of a magnetic-metal piece 203.

Figure 3:
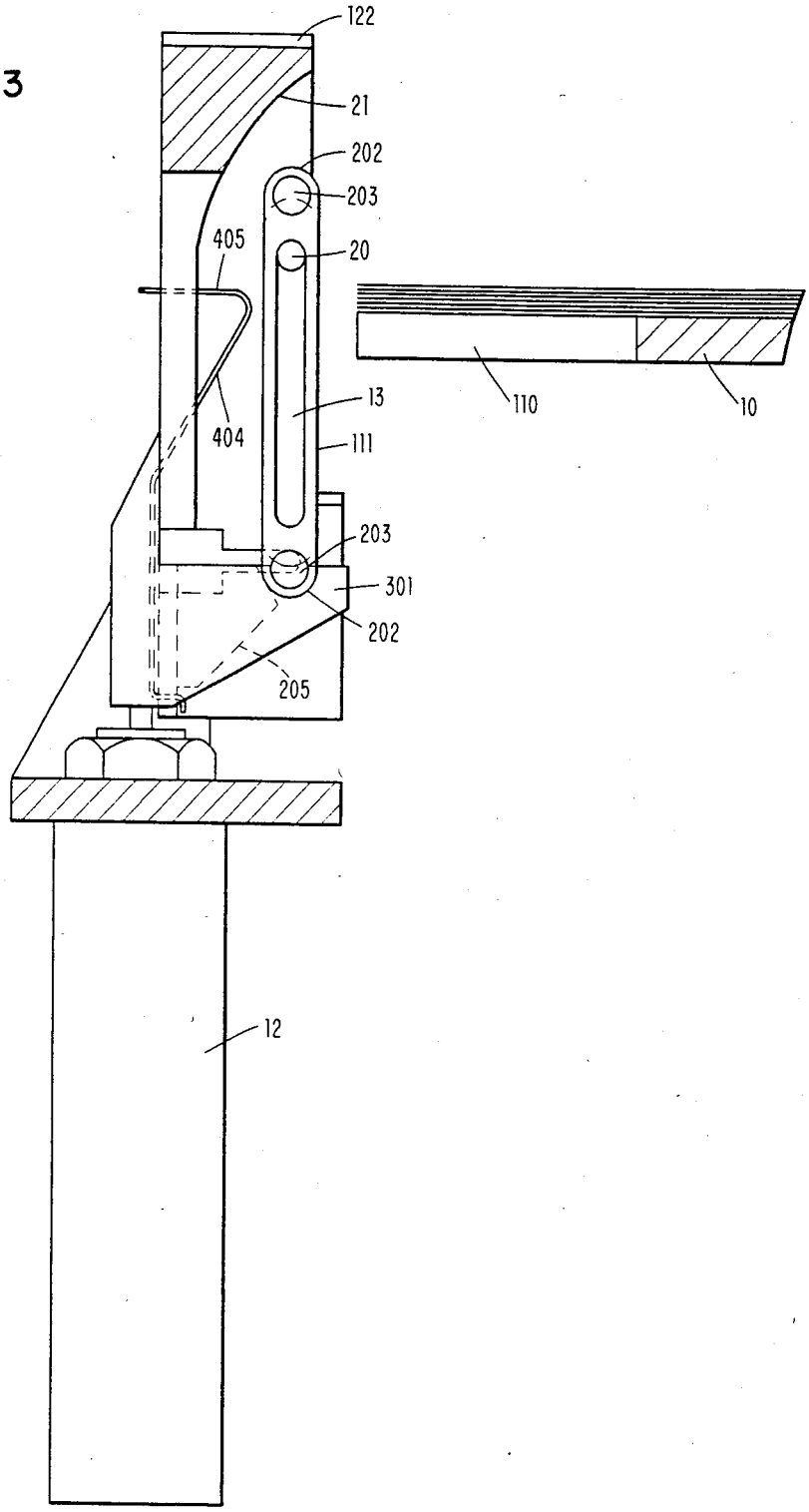
FIG. 3 is a side view, partially in section, of a second embodiment of the present invention, showing the solenoid pusher means in its deenergized and lowered position, and showing a stack of sheets on the FIFO duplex tray.

Housing 122 of this embodiment is plastic and carries stationary permanent magnets 205 and 206. These two magnets align with the two bottom tabs 202 when the finger is in either of its two stable vertical positions. The function of these magnets is to provide a physical stop preventing clockwise rotation of the finger, and the magnetic force stabilizes and control the finger's vertical position, independent of vibration and the like (FIG. 3).

In this embodiment, the finger's position sensor is a light-source/photocell couple 207, 208 which is housed in slots 209, 210 the lower end of housing 122. Any time that the finger occupies one of its two stable vertical positions, the light beam which extends between the light source and the photocell is broken. This effect is used as a signal defining the various positional transitions of the finger, and is used by control logic, not shown, to control energization of solenoid 12, as is needed, dependent upon the requirements of the particular apparatus to which the present invention is applied.

As with the first embodiment of the present invention, solenoid 12 operates to elevate finger 111. In this case, a pusher member 301 includes a horizontal surface 302 (FIG. 9) which elevates the finger. As the finger is elevated, its top tabs 202 engage cam surface 21, and a clockwise pivoting force is applied to the finger. Housing 122 includes a slot 123 (FIG. 9) which accommodates noninterfering movement of pusher 301.

Figure 9:
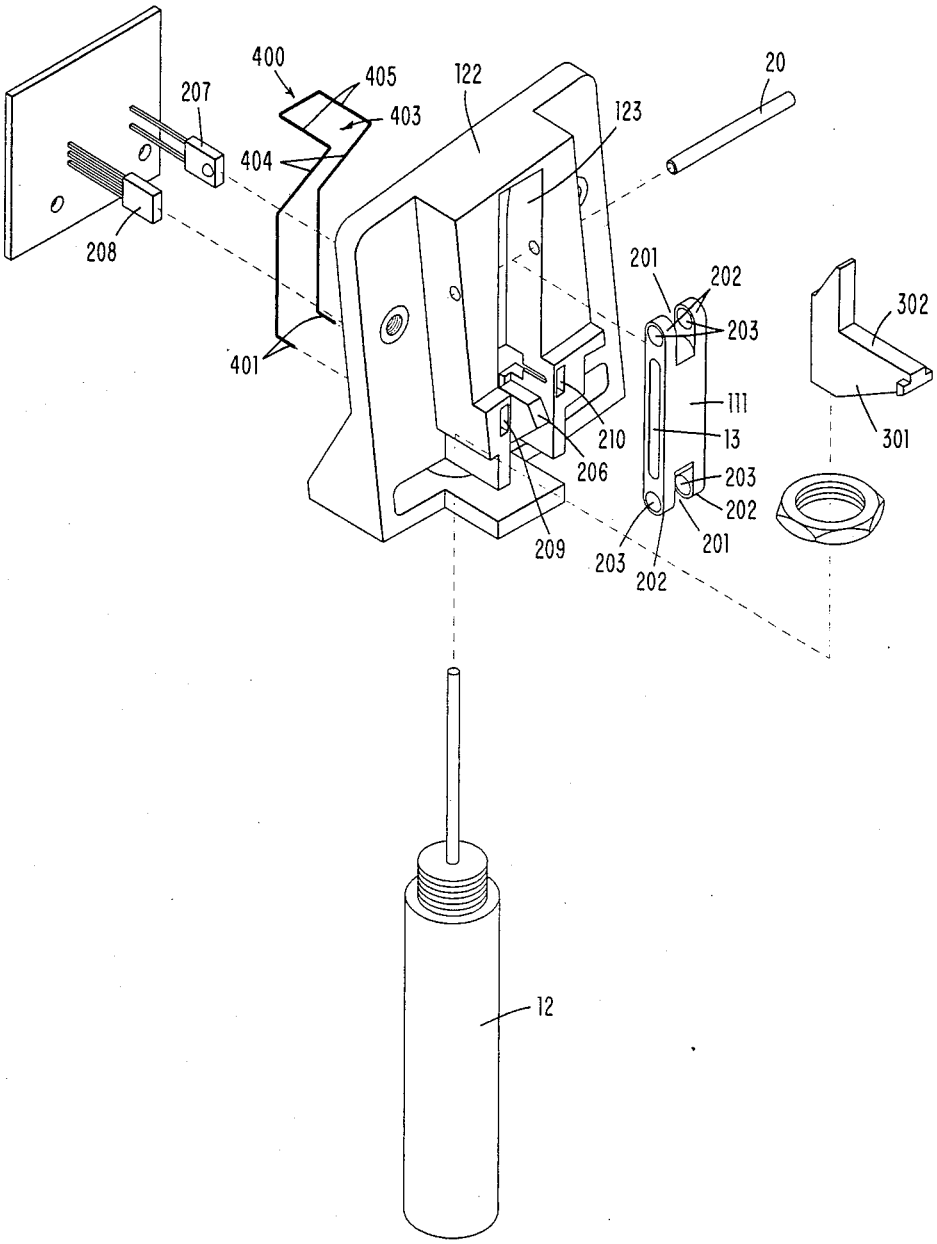

This embodiment of the invention includes a spring-wire member 400 which controls and stabilizes movement of the finger. Member 400 is mounted to housing 122 by way of tabs 401 (FIG. 9). The top, generally horizontal portion of spring member 400 is U-shaped (FIG. 9). The gap 403 formed by this U-shape allows pusher member 301 to move upward unobstructed. However, as the finger gravity-falls, its lower tabs 202 engage the arms 404 of the spring member, and gravity fall is somewhat retarded by the required deflection of the spring member (see FIG. 4). This operates to control pivoting of the finger. In addition, once the finger has pivoted to the extent that the spring member has been deflected, such that the finger rests on a stack of sheets (FIG. 5), the arms 405 of the spring member operate to ensure that the finger cannot rebound off the sheet stack, and possibly pivot back in a counter clockwise direction. Thus, spring member 400 operates to stabilize rotation of the follower finger.

While the invention has been particularly shown and described with reference to preferred embodiments thereof, it will be understood by those skilled in the art that various changes in form and details may be made therein without departing from the spirit and scope of the invention.

What is claimed is:

1. Follower finger apparatus for sensing the removal of an object above which the finger rests, comprising:

a pin member defining a pivot axis;

a rigid follower finger having an elongated, slot-like opening which receives said pin member, said finger being stable in the two generally vertical positions whereat said pin member engages the two opposite ends of said slot-like opening;

a cam surface mounted generally vertically above said pin member;

pusher means operable to elevate said finger relative said pin member, thereby causing said finger to move upward as it is guided by said pin member, and to engage said cam surface during said upward movement, whereupon the top of said finger moves horizontally, causing said finger to fall downward, as said finger pivots about said pin member; and an object-receiving platform constructed and arranged to intercept said pivoting finger when an object resides thereon, and to allow said finger to gravity-fall to a said stable position when an object does not reside on said platform, or subsequently upon removal of the object from said platform.

2. The apparatus of claim 1 including sensor means operable to sense said gravity-falling of said finger to a said stable position.

3. The apparatus of claim 2 including means operated thereafter to again energize said pusher means.

4. The apparatus of claim 3 wherein said finger is symmetrically shaped about the axis of elongation of said slot-like opening, and wherein the upper end surface of said finger engages said cam surface as said finger is elevated by said pusher means, thereby causing the center of gravity of said finger to move away from a vertical plane which contains said pin member, whereupon said finger gravity-rotates about said pin member as said end surface drops toward said object-receiving platform.

5. The apparatus of claim 4 wherein the center of gravity of said finger lies within said plane when said member is in its two stable positions, one stable position being with one end of said slot-like opening being coincident with said pin member, and the other stable position being with the other end of said slot-like opening being coincident with said pin member.

6. The apparatus of claim 5 wherein said pusher member reciprocates between a lower and an upper position, and resides below the lower end surface of said finger when in said lower position, said pusher member moving from said lower to said upper position, and back to said lower position in order to test for the presence of an object on said platform.

7. The apparatus of claim 6 wherein said pin member is a shaft, wherein said follower finger is in the form of a uniform-thickness rigid loop, and wherein said pusher means is a solenoid which is momentarily energized to test for the presence of an object on said platform, or to reset said follower finger on top of an object which has been placed on said platform.

8. Movable finger sensing apparatus, comprising:

a stationary, horizontally extending pivot member defining a pivot axis;

an elongated, rigid finger member having a pair of spaced, substantially parallel walls which meet at opposite wall ends, to thereby define parallel opposite wall surfaces and parallel opposite end surfaces forming an elongated cavity which is loosely occupied by said pivot member;

an actuator positioned below said pivot member, and which is operable to engage the bottom of said finger member, and to elevate said finger member relative said pivot member, while said elongated cavity accommodates said elevational movement;

a stationary cam surface positioned above said pivot member by a distance less than the length of said finger member, said cam surface extending in a direction which includes a horizontal component, to thereby cause said finger member to tilt from the vertical, causing the finger's top end to fall downward, as said finger member pivots about said pivot member;

platform means positioned to intercept said downward fall of said finger member only when an object resides on said platform means; and sensor means located below said platform means in a position to detect the downward passing of said finger member beyond the location of said platform means.

9. The sensing apparatus of claim 8 wherein the opposite ends of said finger member are magnetically attractable, and including stationary magnet means positioned below said pivot member in a position to physically engage and magnetically attract said finger member when said finger member is hanging vertically downward from said pivot member.

10. The sensing apparatus of claim 9 including spring means which momentarily interferes with said downward falling of said finger member.

11. The sensing apparatus of claim 10 wherein said spring means includes a first surface which is deflected by said finger member during said downward fall, and a second surface which prevents counter rotation of said finger means after said deflection and subsequent restoration of said finger member.

12. The sensing apparatus of claim 11 including a photocell detector mounted to detect said finger member when said finger member hangs vertically downward from said pivot member.

13. The sensing apparatus of claim 12 wherein said actuator is a momentary actuator normally positioned below the lower end of said finger member when said finger member is hanging from said pivot member, said actuator being operable to move in a vertical upward stroke, and then to immediately reset to its lower position.

14. The sensing apparatus of claim 13 wherein said finger member is nonmagnetic, and wherein magnetic metal inserts are mounted at the opposite ends of said finger member so as to be shielded from physical contact to said magnet means, said inserts providing a weight which aids the pivoting and downward fall of said finger member.

* * * * *